United States Patent [19]

Bailey et al.

[11] 3,991,575

[45] Nov. 16, 1976

[54] METHOD AND APPARATUS FOR CONVERTING HEAT ENERGY TO MECHANICAL ENERGY

[75] Inventors: Leo L. Bailey, Lake Worth; David R. Kimmel, Lantana, both of Fla.

[73] Assignee: Bailey and Kimmel, Inc., Lake Worth, Fla.

[22] Filed: July 23, 1974

[21] Appl. No.: 491,128

[52] U.S. Cl. ..... 60/669; 122/11

[51] Int. Cl.[2] ..... F01K 11/00

[58] Field of Search ..... 60/669, 670, 674, 516, 60/517, 721; 91/4 R; 122/11

[56] References Cited

UNITED STATES PATENTS

| | | | |
|---|---|---|---|
| 1,557,557 | 10/1925 | Chaussepied | 60/669 |
| 2,075,648 | 3/1937 | Huttner | 60/669 |
| 2,140,175 | 12/1938 | Starziczny | 60/669 |
| 2,961,835 | 11/1960 | Kastner | 60/669 |
| 3,608,311 | 9/1971 | Roesel, Jr. | 60/516 |
| 3,613,368 | 10/1971 | Doemer | 60/669 X |
| 3,890,784 | 6/1975 | Tubeve | 60/516 |

*Primary Examiner*—Martin P. Schwadron
*Assistant Examiner*—H. Burks
*Attorney, Agent, or Firm*—Cushman, Darby & Cushman

[57] ABSTRACT

A method and apparatus for converting heat energy into mechanical energy in which a liquid is maintained against the outer walls of a cylindrical container due to centrifugal force caused by rotation of the container; a plurality of reservoirs are provided extending radially outward from the walls of the container and protruding into a stationary heating device extending around the entire path of rotation of the cylinder and reservoirs. The reservoirs are heated sufficiently to vaporize liquid as it is forced into the reservoirs due to the centrifugal force. A portion of the liquid that is vaporized then forces a portion of the liquid which has not been vaporized to be expelled radially inwardly from the reservoir and against a turbine rotor blade fixed for rotation about the same axis as the cylinder but independently of the rotation of the cylinder to thus provide the power output.

18 Claims, 2 Drawing Figures

METHOD AND APPARATUS FOR CONVERTING HEAT ENERGY TO MECHANICAL ENERGY

BACKGROUND OF THE INVENTION

This invention relates to method and apparatus for the conversion of heat energy into mechanical energy and more particularly to an engine and method which will accomplish this in a continuous manner.

Prior methods and devices have been devised for converting heat energy into mechanical energy in which a liquid is heated until it vaporizes, with the vapor then being directed against the blades of a turbine rotor to produce useful work. Such a device is disclosed in U.S. Pat. No. 2,075,648. A substantial amount of available work energy is lost or not utilized to produce power output in this type of system. The velocity of the vaporized gases must usually be increased by means of a nozzle which directs the high velocity gases againts the rotor of the turbine. This type of system results in only a small proportion of the energy available in the gases being utilized to cause useful work.

Also, once the gases leave the nozzle they tend to expand rapidly and lose a substantial portion of their velocity a very short distance from the nozzle. Thus, the use of gases as the transfer agent from the heat energy to the mechanical output, is inherently less efficient than a system such as would utilize the principle of a water wheel or a solid mass of liquid propelled against the tubine rotor blades. On the other hand, the use of a system where a liquid is vaporized is inherently desirable as a medium for transforming heat energy into mechanical energy due to the natural expansion or pressure created by the heat input to the liquid causing it to vaporize.

SUMMARY OF THE INVENTION

The present invention combines the advantages of a system utilizing a vaporization of the liquid to transfer heat energy into mechanical energy in combination with a system of utilizing a liquid as the momentum transferring agent between the expansion chamber and the turbine rotor blade.

This is accomplished by a method wherein the heat energy is continuously converted into mechanical energy by rapidly heating a first portion of the liquid in a fluid containing reservoir to a sufficient temperature to cause rapid vaporization of that first portion of liquid. The second portion of liquid which has not been vaporized is then expelled through an opening in the fluid containing reservoir as a result of the expansion of the first vaporized portion. The liquid is then propelled by this means against the blades of the turbine rotor causing rotation thereof so as to provide useful work.

One form of apparatus devised to accomplish the above process includes a reservoir for containing a liquid having at least one opening in an end portion thereof, and having a heating device associated with the reservoir for rapidly heating the first portion of the liquid remote from the opening to a sufficient temperature to cause rapid vaporization of that portion of the liquid so as to force the second portion of the liquid, which has not been vaporized, and which is disposed adjacent said opening, to pass through the opening and impinge upon the blades of the turbine rotor disposed adjacent thereto and fixed for rotation about an axis so that movement imparted thereto can be readily utilized for useful work.

DETAILED DESCRIPTION OF THE PREFERRED EMBODIMENT

Figure 1:
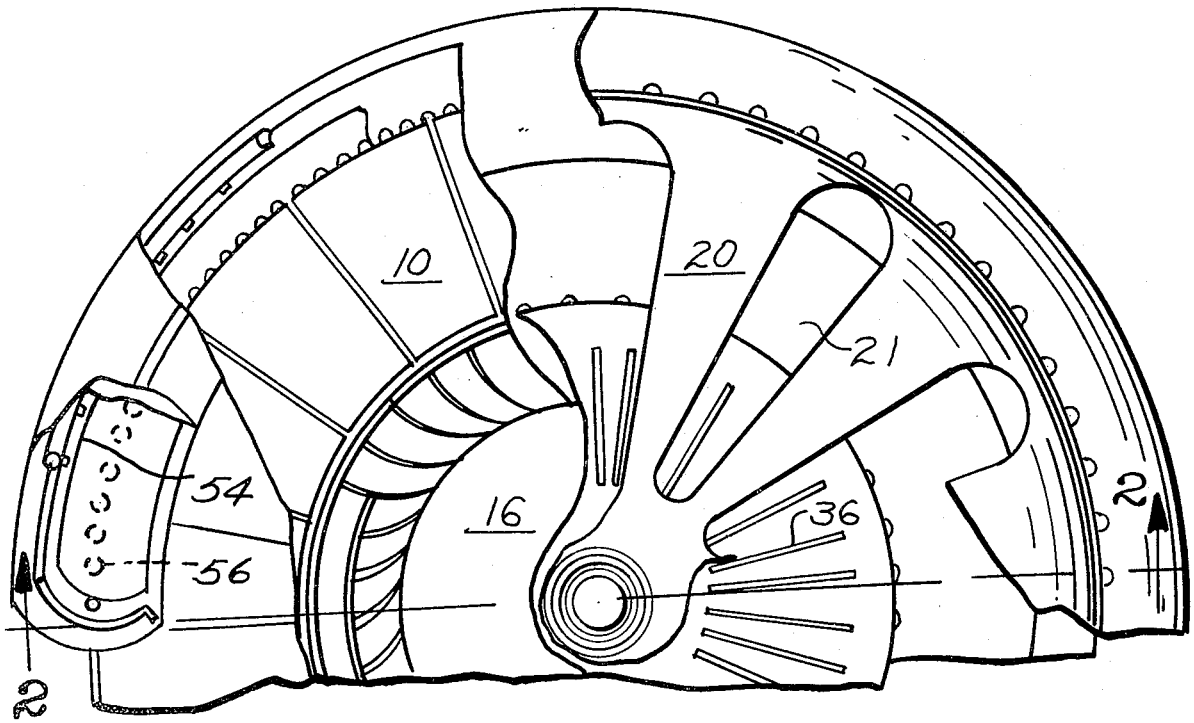
FIG. 1 is a top plan view in partial cross-section of an embodiment of the present invention.
Figure 2:
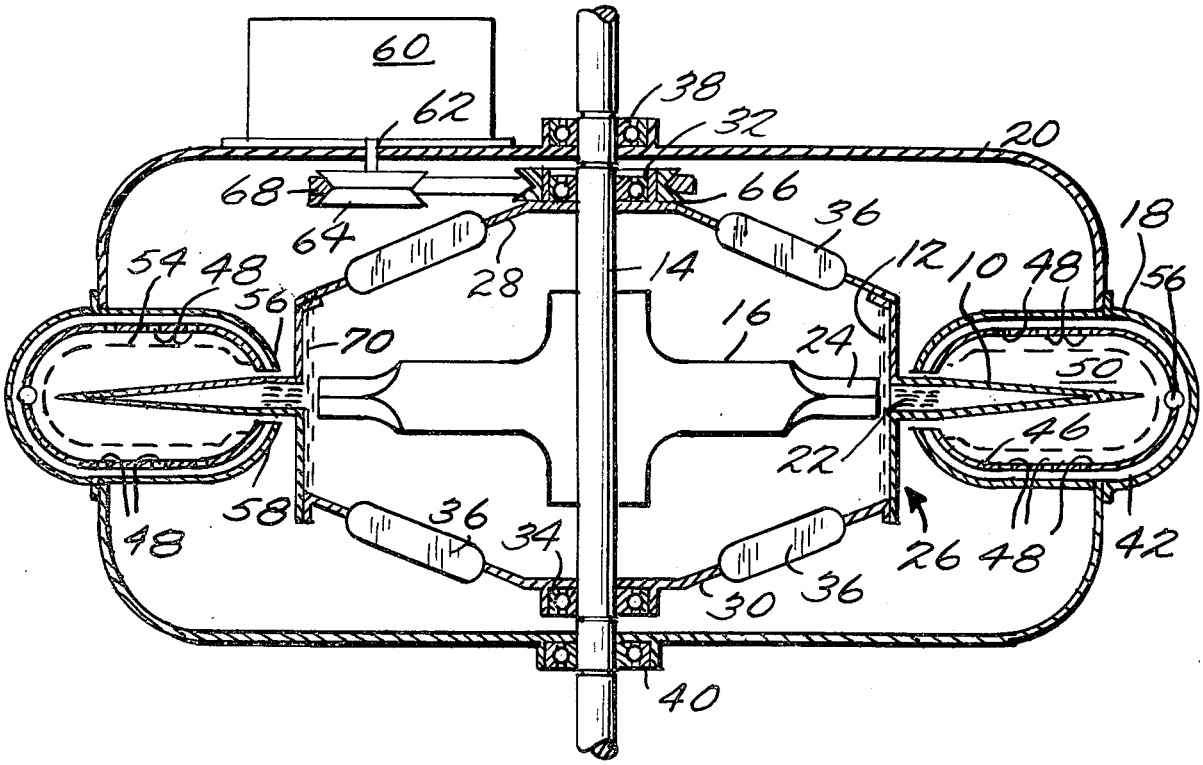
FIG. 2 is a side plan view in cross-section taken along line 2 — 2 in FIG. 1.

The preferred embodiment as illustrated in FIGS. 1 and 2, uses a relatively small number of moving parts compared to standard internal combustion engines and is thus inherently less susceptible to mechanical failure as well as substantially less complicated in design than are such standard and widely used engines. The basic components of the preferred embodiment comprise a reservoir 10 secured to a catch basin 12 for rotation about shaft 14, a rotor member 16 secured to shaft 14 for rotation therewith, and a heating device 18 secured to a frame structure 20 with respect to which the shaft 14 and rotor 16 as well as the reservoir 10 and catch basin 12 are free to rotate.

The reservoir 10 is preferably a wedge shaped member extending radially outwardly from the axis of rotation about which a shaft 14 rotates. A plurality of these resevoirs are disposed adjacent to one another radially in a circle about the axis of rotation with the apex of the wedge extending away from the axis. The opening 22 in reservoir 10 is disposed adjacent the blade portion 24 of rotor 16 so that, as more fully described later, the liquid expelled from reservoir 10 impinges upon blade 24.

The plurality of reservoirs 10 are secured to catch basin 12 which has a cylindrical portion 26 to which reservoir 10 is secured. Oppening 22 opens into the catch basin for purposes to be described later on. Upper and lower closure portions 28 and 30 provide a closed container so that liquid enclosed therein will not escape. Any means (not shown) may be provided for filling and/or replenishing the supply of liquid in catch basin 12 so long as it prevents substantial loss of liquid or vapor during operation of the engine. The closure members 28 and 30 have a circular opening through which shaft 14 is permitted to freely rotate. The portions of enclosure members 28 and 30 adjacent shaft 14 are secured to bearings 32 and 34 respectively, so as to be free to rotate about the shaft and to, as well, allow the shaft to freely rotate itself. Sealing means (not shown) should likewise be provided between the circular openings in closure members 28 and 30 and shaft 14 so as to prevent substantial loss of liquid or vapor during operation of the engine.

A plurality of vanes 36 are provided on the enclosure members 28 and 30 so as to increase the heat transfer due to radiation and thus aid in cooling the apparatus to be described more fully below.

The rotor 16 is secured to shaft 14 for rotation therewith and is mounted to frame member 20 by means of bearings 38 and 40 the end portions of the shaft, or either one, can be utilized as a power takeoff and adapted in any manner to be coupled to a member for providing motivational power thereto. Blade portion 24 of rotor 16 is disposed adjacent openings 22 and is free to rotate relative thereto.

The heating device 18 is preferably composed of an outer air chamber 42 constructed of outer wall 44 and inner wall 46 the latter of which contains a plurality of openings 48 through which air is permitted to enter into the burning chamber 50. Secured to inner wall 46 is a fuel line 52 also containing a plurality of holes to provide fuel to the burning chamber 50 wherein it is ignited. Both a fuel supply and an air supply (neither of which are shown) are utilized for controlling the amount of fuel and air supplied to the engine in sufficient and appropriate quantities to support conbustion.

One means of providing ignition of the fuel is an incandescent screen 54, spaced internally from inner wall 46 which can provide sufficient heat to ignite the fuel. The screen 54 contains holes 56 through which the air and fuel mixture are presented into the chamber 50 of the heating device 18. End portions 56 and 58 of heating device 18 should preferably be close to the sides of reservoir 10 so as to reduce the escape of heat and increase efficiency of the heating system. The end portions 56 and 58, however, should not contact the sides of reservoir 10 since the opening is utilized as the means for exhausting gases from the chamber 50 after ignition and burning thereof. In addition, a heat shield (not shown) can be secured to the sides of reservoirs 10 outside of the heating device 18 and spaced from the bottom wall of basin 26 so as to prevent or reduce the amount of heat transferred by radiation to the base of basin 26 as a result of the gases being exhausted. Also, a conventional exhaust removal system (not shown) may be utilized to remove the gases from inside of frame member 20.

A variable speed motor 60 is secured to frame member 20 with the power drive shaft 62 extending into the frame member 20 in corresponding relation to bearing 32. Pulleys 64 and 66 are secured to shaft 62 and closure member 28 respectively. Pulley 66 is preferably secured to the outer race of bearing 32 which in turn is secured to closure member 28. A V-belt 68 extends between the pulleys and provides the drive transfer means from motor 62 to the enclosure means 28 and catch basin 12.

In operation, the incandescent screen 54 is heated to a temperature which will ignite the fuel air mixture which is provided in the chamber 50. The fuel is injected through holes in fuel line 52 and air is injected through holes in air chamber 42 all of which combines to be ignited in chamber 50. The temperature of reservoir 10 is then increased and maintained at a temperature which will rapidly vaporize the liquid being utilized in the system. The thickness of walls of the reservoir 10 is an important consideration since this will have a substantial effect on the speed of operation of the system since for example, if the walls are thin the heat transfer through the walls to the fluid to be vaporized will be much faster than if relatively thick walls are used. The time required to resupply the heat needed for vaporization being relatively easy to calculate from known computation methods. Thin walls are preferred since the time required to resupply the heat of vaporization is reduced, thus increasing the responsiveness of the engine to increases in heat in the ignition chamber 50, however, it is understood that if relatively thicker walls are used in reservoir 10 a greater heat sink is provided to sustain continuous operation of the engine at a continuous speed. The actual thickness of the walls should therefore be based on the desired use of the engine.

As the liquid 70, herein for the sake of example considered to be water is forced into the reservoir 10 from catch basin 12 as a result of the centrifugal force due to rotation of the catch basin, it is rapidly vaporized as it approaches the apex of the wedge since the volume of liquid at that point is substantially less than the volume of the liquid near opening 22 of reservoir 10 thus required less heat transfer to reach the point of vaporization. This rapidly vaporized liquid forces the liquid which followed it into the chamber to be expelled through opening 22 and, thus, impinges upon blade 24 of rotor 16. The vaporized portion of the liquid is likewise expelled from reservoir 10 due to its expansion and the cycle is repeated as a result of additional liquid 70 which is already disposed in catch basin 12, being forced into reservoir 10. This also forces any residual vaporized liquid out of reservoir 10 through opening 22. The new liquid is again vaporized and the cycle repeated. As this cycle is continuously repeated in the plurality of reservoirs 10 the rotor 16 and shaft 14 are accelerated and brought to a maximum speed depending upon the cyclical rate of the previously described cycle of operation for the individual reservoirs. This cyclical rate, and thus the ultimate or maximum speed of rotation of rotor 16 and ultimately shaft 14, is dependent upon the rate of heat transfer through the walls of reservoir 10 and the amount of heat generated in chamber 50. Thus, the speed of the engine can be controlled by controlling the amount of fuel injected into chamber 50.

The centrifugal force which causes the liquid 70 to be forced into reservoir 10 is dependent upon the speed of rotation of the catch basin 12 which is caused by motor 60. This speed of rotation likewise has an effect upon the ultimate speed of shaft 14 since the speed with which the liquid 70 enters reservoir 10 is a result of the pressure on liquid 70 created by the centrifigal force due to rotation. At least, sufficient speed of rotation of catch basin 12 should be provided such that liquid expelled from opening 22 is forced to migrate towards catch basin 12 after it is expelled from opening 22 and strikes the closure members 28 and 30.

The vanes 36 are provided both internally and externally of closure members 28 and 30 to both cool the vaporized liquid internally of the enclosure members and catch basin so that it will condense and return to the catch basin 12, as well as to cool the exhausted gases containing within frame member 20, externally of the closure members 28 and 30 and to assist in removal of the exhausted gases and the heat contained therein by forcing them out through an exhaust system (not shown).

In order to effect heat transfer in the appropriate direction through vanes 36, i.e. to transfer heat from inside the enclosure members 28 and 30 to the atmosphere outside of frame 20, a plurality of openings 21 in frame 20 are utilized to permit the air surrounding the engine to enter and mix with the hot exhaust gases and thus cool them so as to reduce the temperature of gases adjacent the surface of vanes 36 on the outside of closure members 28 and 30 so that it is lower than the temperature of the condensing gases inside the closure members, thus causing heat transfer from inside to outside the closure members to effect the desired condensation of the vaporized liquid. As mentioned above, the movement of vanes 36 then causes exhaustion of these gases to an appropriate exhaust system.

Although the foregoing description of the preferred embodiment illustrates one manner in which the method for transforming heat energy into mechanical energy described herein may be utilized, it will be apparent to those skilled in the art that variations in both the method and apparatus described are possible. All such variations as would be obvious to those skilled in this art are intended to be included within the scope of this invention.

What is claimed is:

1. A method of continuously converting heat energy into mechanical energy, comprising:

rapidly heating a first portion of a liquid in a fluid containing reservoir, to a sufficient temperature to cause rapid vaporization of said portion;

expelling a second portion of said liquid through an opening in said reservoir by means of a pressure created in said reservoir due to the rapid vaporization of said first liquid portion;

directing said expelled second portion of said liquid against one of a plurality of blades secured for rotation about a fixed axis, so as to cause said blades to rotate; and resupplying liquid to said reservoir and thereby expelling said vaporized first portion through said opening.

2. A method as defined in claim 1 and further comprising after the step of directing said liquid against said blade the step of:

collecting said expelled second portion of said liquid in a catch basin adjacent to said reservoir and in communication with said opening.

3. A method as defined in claim 2 and further comprising:

providing a closed chamber containing said catch basin for allowing said vaporized portion of said liquid to be condensed, and collecting said condensed liquid in said catch basin.

4. A method as defined in claim 2 wherein said step of resupplying liquid to said reservoir includes the step of:

forcing said liquid from said basin into said reservoir through said opening.

5. A method as defined in claim 3 wherein said step of forcing said liquid into said reservoir is accomplished by rotating said reservoir and said basin about said axis so as to create sufficient centrifugal force to maintain said liquid in said basin and to force it into said reservoir.

6. A method of continuously converting heat energy into mechanical energy, comprising:

rotating a container containing a liquid, so as to cause the liquid to be held agaist the sides of the container, and further causing portions of the liquid to be forced outwardly from the container through openings into a plurality of reservoirs attached to the container and rotated therewith, rapidly heating a first part of each of the portions of the liquid so expelled and remote from the openings sufficiently to cause rapid vaporization thereof, expelling a second part of each of the portions of the liquid through the openings towards the axis of rotation of the container by means of the pressure created in the reservoirs due to the rapid vaporization of the first parts of liquid, directing each expelled second part of the liquid against a blade means secured for rotation about the axis of rotation of the container and free to rotate independently of the container, so as to cause said blade means to rotate to produce torque which may be utilized to produce useful work, collecting the expelled liquid and returning it to the sides of the container where it is again held by centrifugal force, forcing other portions of the liquid outwardly through the openings into the reservoirs and expelling the vaporized parts of the liquid from the reservoirs into said container, and condensing the vaporized parts of the liquid and collecting the condensed liquid in the container so that it will return to the sides of the container and be held there by centrifugal force for further use.

7. A method as defined in claim 6 wherein the steps are permitted to occur randomly with respect to individual reservoirs.

8. An engine comprising:

a reservoir for containing a liquid and having at least one opening in an end portion thereof;

heating means associated with said reservoir for rapidly heating a first portion of said liquid remote from said opening to a sufficient temperature to cause rapid vaporization of said portion so as to force a second portion of said liquid adjacent said opening through said opening;

blade means disposed outside of said reservoir adjacent said opening and secured for rotation relative to said reservoir for converting the force produced by said second portion of liquid being expelled from said opening and impinging upon said blade means, into torque which may be utilized to produce useful work.

9. An engine as defined in claim 8 and further including a catch basing adjacent to said reservoir and in communication with said opening.

10. An engine as defined in claim 8 wherein said heating means is a container in which a fuel can be ignited and burned and which has an opening through which a portion of said reservoir extends so as to be heated by said burning fuel.

11. An engine as defined in claim 9 wherein said reservoir and said catch basin are fixed relative to each other and mounted for rotation relative to said heating means and said blade means.

12. An engine as defined in claim 11 wherein a plurality of reservoirs are disposed radially about said axis of rotation and said heating means is also disposed radially about said axis and surrounds a portion of each said reservoir remote from said opening therein.

13. An engine as defined in claim 12 wherein said reservoirs and said blade means are independently mounted for rotation relative to each other about said axis.

14. An engine comprising:

a container means secured for rotation about a central axis for containing a liquid and having outer wall portions against which the liquid can be maintained due to centrifugal force of rotation of the container means, a plurality of reservoir means secured to and in communication through a plurality of openings with said container means and extending radially outwardly from and around the wall portions of the container means for receiving liquid therefrom, heater means disposed radially around at least the outer most portions of said plurality of reservoir means in surrounding relation thereto for heating said plurality of reservoir means to a sufficient temperature to cause first portions of said liquid in said outer most portions of said reservoir in each said reservoir means to be rapidly vaporized so as to cause second portions of said liquid to be expelled inwardly through said openings towards said axis of rotation, blade means mounted for rotation about said axis independently of said container means and in operative relationship to said openings for converting the force applied to said blade means by said expelled second portions of said liquid into torque for producing useful work, chamber means associated with said container for catching and collecting said second portions of said liquid after impinging on said blade means and for collecting said first portions of said liquids when they have condensed after being expelled from said reservoirs.

15. A method of continuously converting heat energy into mechanical energy, comprising:

rapidly heating a first portion of a liquid in a fluid containing reservoir, to a sufficient temperature to cause rapid vaporization of said portion;

expelling a second portion of said liquid through an opening in said reservoir by means of the pressure created in said reservoir due to the rapid vaporization of said first liquid portion;

directing said expelled second portion of said liquid against a movable surface means adapted for transmitting the resultant force to a power output means to produce useful work; and resupplying liquid to said reservoir and thereby expelling said vaporized first portion through said opening.

16. An engine comprising:

a reservoir for containing a liquid and having at least one opening in an end portion thereof;

heating means associated with said reservoir for rapidly heating a first portion of said liquid remote from said opening to a sufficient temperature to cause rapid vaporization of said portion so as to force a second portion of said liquid adjacent said opening through said opening;

movable surface means disposed adjacent said opening and movable relative to said reservoir for converting the force produced by said second portion of liquid being expelled from said opening and impinging upon said movable surface means, into torque which may be utilized to produce useful work.

17. A method of converting heat energy into mechanical energy in a cyclical manner wherein each cycle comprises:

rapidly heating a liquid in a fluid containing means to a sufficient temperature to cause vaporization of a first portion of the liquid;

expelling a second portion of the liquid from the fluid containing means as a result of the pressure developed in the fluid containing means due to the vaporization of the first liquid portion;

directing the expelled second portion of the liquid against a movable surface means adapted for transmitting the resultant force to a power output means to produce useful work;

condensing at least a portion of the previously vaporized first portion of the liquid; and resupplying liquid to the fluid containing means, to complete the cycle.

18. An apparatus for converting heat energy into mechanical energy comprising:

fluid containing means;

heating means for rapidly heating a liquid contained in the fluid containing means so as to cause vaporization of a portion thereof;

movable surface means adapted for transmitting force to a power output means to produce useful work;

means communicating an unvaporized portion of the liquid in the fluid containing means with the movable surface means so as to permit the unvaporized portion of the liquid to be expelled from the fluid containing means due to the pressure developed in the fluid containing means due to the vaporization of a portion of the liquid, and impinge upon the movable surface means as to cause movement thereof;

means for condensing at least a portion of the previously vaporized first portion of the liquid; and means for resupplying liquid to the fluid containing means.

* * * * *